US006129062A

United States Patent [19]

Koda

[11] Patent Number: 6,129,062

[45] Date of Patent: Oct. 10, 2000

[54] CAMSHAFT PHASE CHANGING APPARATUS

[75] Inventor: Masanori Koda, Kanagawa, Japan

[73] Assignee: Unisia Jecs Corporation, Atsugi, Japan

[21] Appl. No.: 09/323,886

[22] Filed: Jun. 2, 1999

[30] Foreign Application Priority Data

Jun. 3, 1998 [JP] Japan ..... 10-154063

[51] Int. Cl.[7] ..... F01L 13/00

[52] U.S. Cl. ..... 123/90.17; 123/90.37

[58] Field of Search ..... 123/90.15, 90.17, 123/90.31, 90.33, 90.34, 90.37

[56] References Cited

U.S. PATENT DOCUMENTS 5,483,930 1/1996 Moriya et al. ..... 123/90.17
5,669,343 9/1997 Adachi ..... 123/90.17
5,797,363 8/1998 Nakamura ..... 123/90.17
5,816,205 10/1998 Moriya ..... 123/90.17
6,024,061 2/2000 Adachi et al. ..... 123/90.17

*Primary Examiner*—Weilun Lo
*Attorney, Agent, or Firm*—Foley & Lardner

[57] ABSTRACT

In a camshaft phase changing apparatus for an internal combustion engine, a plurality of sealed surfaces are formed between an inner peripheral surface of a predetermined hole (a retaining hole formed in an engine cylinder block) present between respective annular hydraulic introducing grooves and an outer peripheral surface of a valve body of an electromagnetic type hydraulic control valve and a length of one of the sealed surfaces having a first difference in pressure is set to be longer than that of the other of the sealed surfaces having a second difference in pressure, the first difference in pressure being larger than the second difference in pressure. In the embodiment, an axial length (S1, S1) of each of the one of the sealed surfaces is set to be longer than that (S2, S2) of each of the others of the sealed surfaces.

9 Claims, 4 Drawing Sheets

CAMSHAFT PHASE CHANGING APPARATUS

BACKGROUND OF THE INVENTION a) Field of the Invention

The present invention relates to a camshaft phase changing apparatus for varying a timing of a valve actuation for an engine driven camshaft.

b) Description of the related art

A Japanese Patent Application First Publication No. Heisei 7-139316 published on May 30, 1995 exemplifies a previously proposed camshaft phase changing apparatus in an internal combustion engine.

The previously proposed camshaft phase changing apparatus disclosed in the above-identified Japanese Patent Application First Publication includes: a cylindrical timing pulley to which a torque is transmitted from a timing belt via a crankshaft of the engine; a camshaft having a cam on an outer peripheral surface thereof and a sleeve fixed on one end of the camshaft and inserted into a cylindrical main body of the timing pulley; and a cylindrical gear which is enabled to move in a forward-and-rearward direction thereof and is meshed via outer and inner beleved teeth thereof with the cylindrical main body of the timing pulley and the sleeve.

The previously proposed camshaft phase changing apparatus further includes: advance-angle side and retardation-angle side hydraulic chambers formed within an internal of the cylindrical main body of the timing pulley, into which a predetermined working oil is supplied via a hydraulic circuit, and from which the pressurized working oil is exhausted via the hydraulic circuit. Hence, the cylindrical gear is moved in the forward-and-rearward direction thereof according to a difference in the hydraulic pressures in the advance-angle side hydraulic chamber and the retardation-angle side hydraulic chamber so that a relative rotational phase between the timing pulley and the camshaft is converted. Thus, a vale-opening-and-closing timing thereof, for example, a suction valve is controlled toward an advance angle side or toward a retardation angle side.

In addition, a hydraulic control valve is interposed in hydraulic passages communicating the respective advance-angle side and retardation-angle side hydraulic chambers with a working oil pump.

A spool valve body having a large-diameter portion and small-diameter portion is slidably held within a cylindrical valve seat. In addition, a plurality of openings communicating with the hydraulic passage are formed at predetermined positions on a peripheral wall of the valve seat along an axial direction of the spool valve body. In order to render a leaked working oil to fall within an allowable range, a seal length of the adjacent openings having a high hydraulic pressure difference is set to be elongated and the seal length between the adjacent openings having a low hydraulic pressure difference is set to be short. Consequently, an axial length of the whole valve seat can be shortened.

SUMMARY OF THE INVENTION

In the previously proposed camshaft phase changing apparatus, a length of sealed surfaces formed between the valve body and the spool valve body is prescribed in such a manner that a leakage quantity of a working oil falls within an allowable range of quantity.

However, no consideration is paid to a sealed surface between a valve body and, e.g., a retaining hole of an engine cylinder block into which the valve body is inserted and fixed tightly. That is to say, in a hydraulic pressure control valve of the above-described cam phase changing apparatus, in terms of a layout purpose into the engine body, the valve body is inserted into and fixed tightly with the retaining hole formed in the cylinder block, hydraulic pressure introducing grooves to be communicated with the hydraulic passages and respective openings are formed on an inner peripheral surface of the retaining hole of the cylinder block.

Therefore, a difference in pressure present between each adjoining introducing groove causes the leakage in the working oil to occur. In details, when each opening is closed by means of the spool valve, the working oil leaks from a hydraulic pressure supplying side at which the difference in pressure between each hydraulic introducing groove is high to a hydraulic pressure draining side at which the difference in pressure between each introducing groove is low. Consequently, a control response characteristic of the valve timing is deteriorated. Together with this, an increase in a consumption of the working oil used for a lubrication of the engine causes a supply quantity of the lubricating oil onto each slidable portion such as a piston of the engine to be decreased.

Especially, when the spool valve body is retained at an intermediate position in an axial direction thereof, a hydraulic pressure variation acted upon each hydraulic chamber via a rotatable body due to a rotation variation torque of the cam shaft causes the leakage quantity of the working oil to be increased. Hence, it becomes necessary to previously increase a reservation quantity of the working oil within an oil pan and to enlarge a capacity of an oil pump.

It may be considered that such a seal member as an O-ring is interposed between the inner peripheral surface of the retaining hold and the outer peripheral surface of the valve body to seal between each introducing groove.

However, a fitting groove for the O-ring may be needed at a predetermined position of the inner peripheral surface at the retaining hole or of the outer peripheral surface of the valve body. In addition, when the valve body is pressurized into the retaining hole, an outer end edge of the O-ring is brought in close contact with an edge of a valve hole, a part of the O-ring is damaged or cut out. Such inconvenience as described above would occur. Consequently, a cost of manufacturing and assembling the hydraulic control valve is accordingly increased.

It is, therefore, an object of the present invention to provide an improved camshaft phase changing apparatus for an internal combustion engine which can effectively prevent a leakage of a working oil from an electromagnetic type hydraulic control valve in the cam shaft phase changing apparatus to hydraulic draining ports without increase in cost of manufacturing and assembling the hydraulic control valve.

The above-described object can be achieved by providing an apparatus for an internal combustion engine, comprising: a rotary body driven by the engine to be rotated in synchronization with a revolution of the engine; a camshaft rotatable about a camshaft axis together with the rotary body; a phase conversion mechanism, the phase conversion mechanism being intervened between the rotary body and the camshaft, the phase conversion mechanism converting a hydraulic pressure responsive movement into a rotational phase relationship between the rotary body and the camshaft; a pair if advance-angle and retardation-angle side hydraulic chambers, the pair of the advance-eagle and retardation-angle side hydraulic chambers being formed in an inner space between the rotary body and the camshaft and partitioned by the phase conversion mechanism and moving the phase conversion mechanism according to the difference in the hydraulic pressures supplied thereinto: a hydraulic circuit, the hydraulic circuit including a plurality of hydraulic passages relatively supplying and draining the hydraulic pressures to and from the pair of the advance-angle side and the retardation-angle side chambers via the hydraulic passages to create a difference in the hydraulic pressures between the pair of the advance-angle and the retardation-angle side hydraulic chambers and having hydraulic draining passages; and a hydraulic pressure control valve, the hydraulic pressure control valve being interposed in the hydraulic circuit and controllably switching a direction of a working oil between the respective hydraulic passages, the hydraulic pressure control valve including: a valve body fixedly inserted into a predetermined hole; a hydraulic supply port, the supply port being formed on a peripheral wall of the valve body and being communicated with a hydraulic pressure source; a plurality of hydraulic supply-and-draining ports, each supply-and-draining port being formed on the peripheral wall of the valve body and being communicated with the corresponding one of the hydraulic passages; a plurality of hydraulic draining ports, each of the draining ports being formed on the peripheral wall of the valve body and being communicated with the corresponding one of the hydraulic draining passages; a spool valve body slidably installed within the valve body, the spool valve body opening and closing the supply port and the draining ports; and a plurality of hydraulic pressure introducing grooves, each hydraulic pressure introducing groove being formed between an inner peripheral surface of the predetermined hold and an outer peripheral surface of the valve body, and wherein a plurality of sealed surfaces are formed between the inner peripheral surface of the predetermined hole and the outer peripheral surface of the valve body, and wherein a length of one of the sealed surfaces having a first difference in pressure is set to be longer than that of the other of the sealed surfaces having a second difference in pressure, the first difference in pressure.

BEST MODE FOR CARRYING OUT THE INVENTION

Reference will hereinafter be made to the drawings in order to facilitate a better understanding of the present invention.

Figure 1:
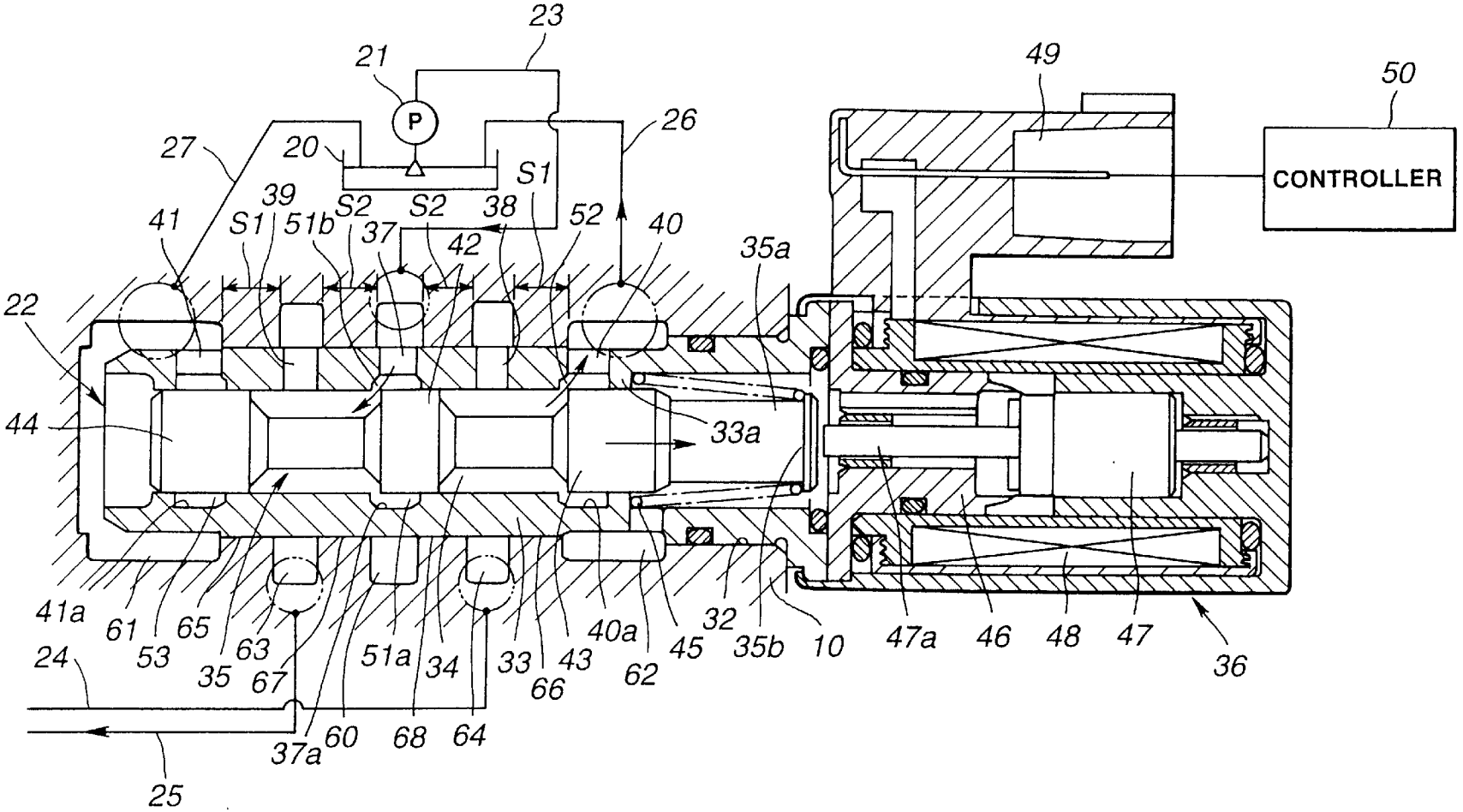
FIG. 1 is a longitudinally cross sectional view of an electromagnetic type controlled hydraulic control valve in a camshaft phase changing apparatus in a preferred embodiment according to the present invention.
Figure 2:
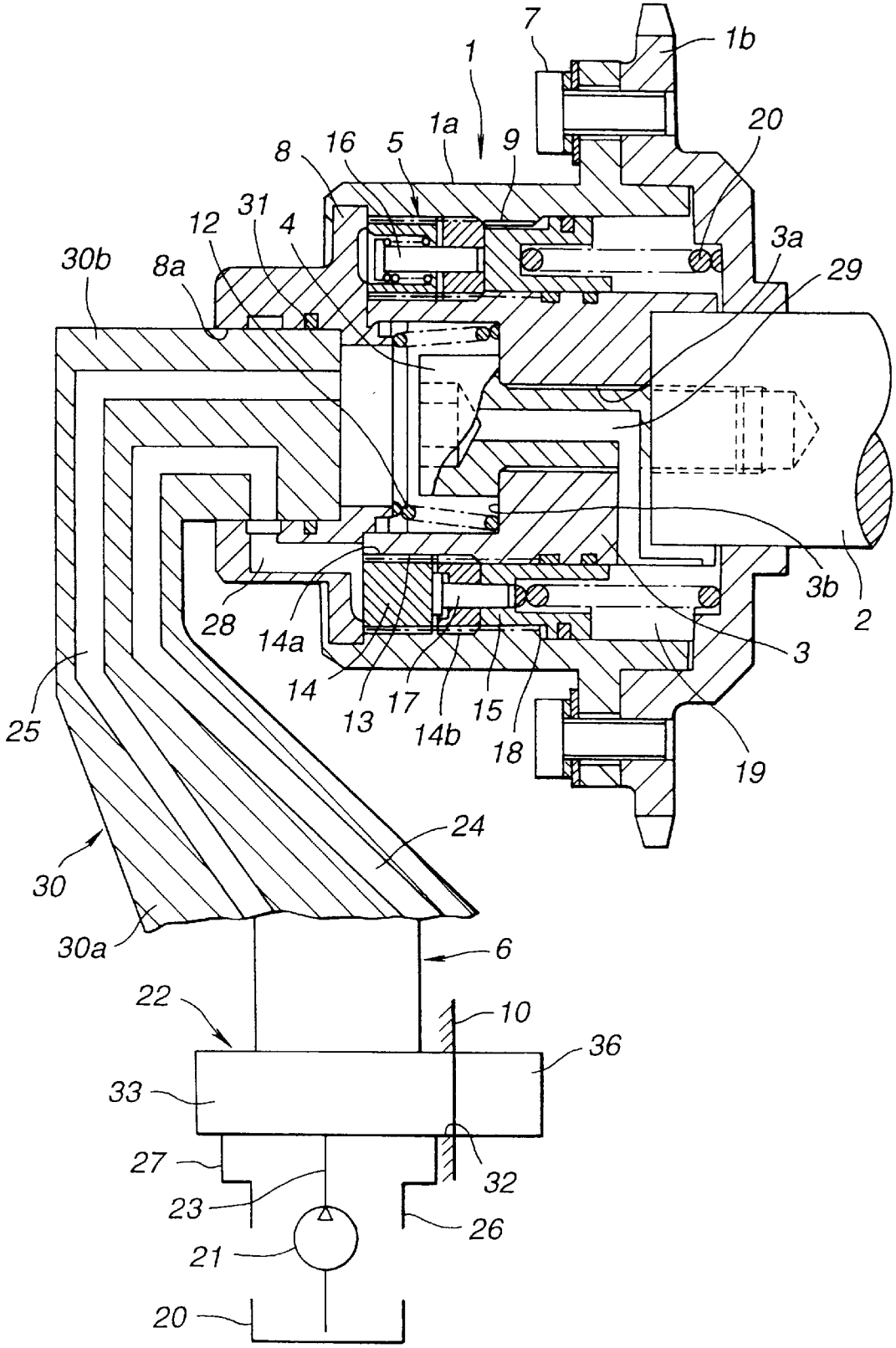
FIG. 2 is a whole cross sectional view of the camshaft phase changing apparatus in the preferred embodiment whose hydraulic control valve is shown in FIG. 1.
Figure 3:
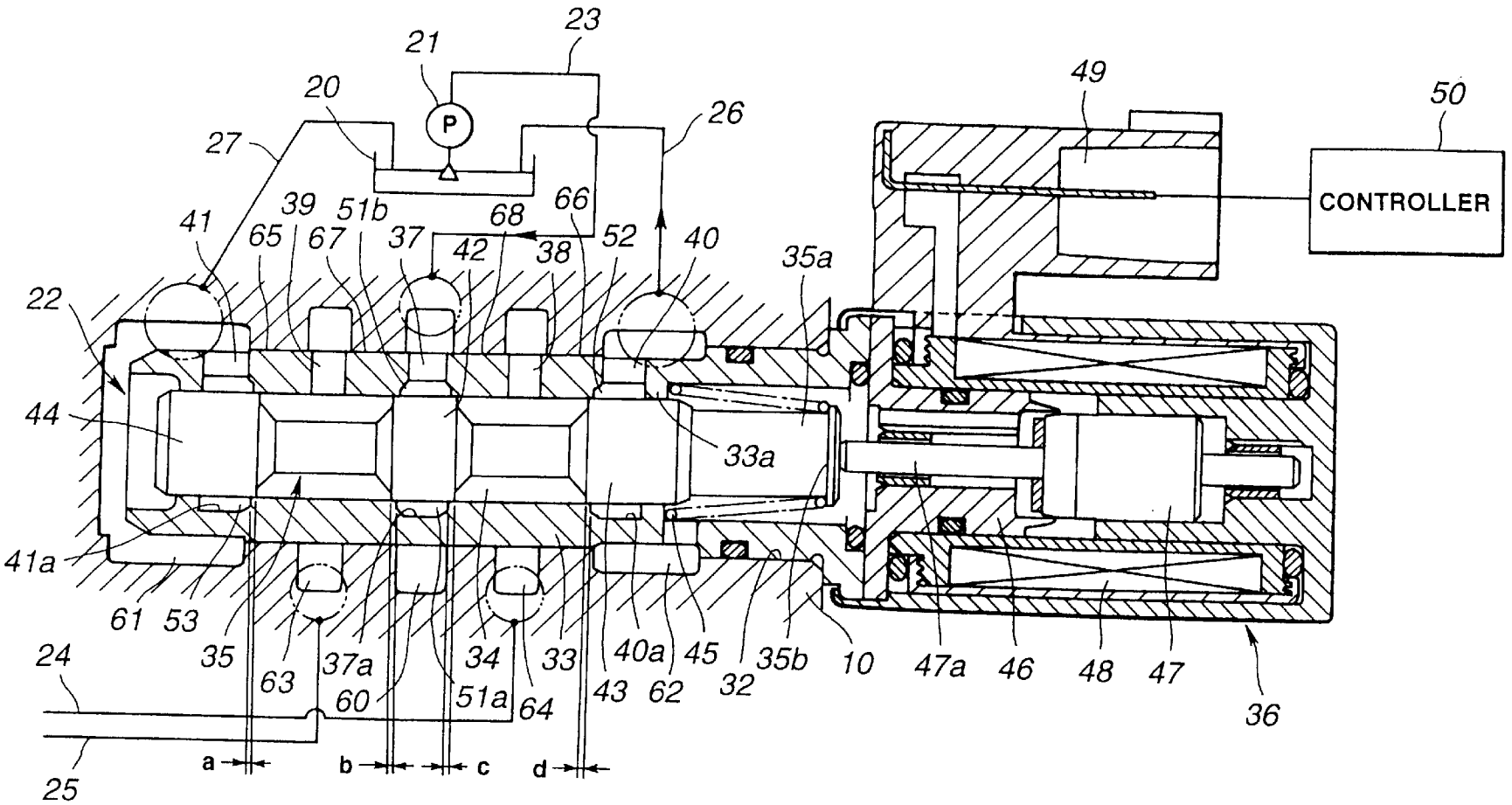
FIGS. 3 and 4 are longitudinally cross sectional views of the hydraulic control valve shown in FIG. 1, each for explaining an operation of an essential part of the control valve shown in FIG. 1.

FIGS. 1, 2, and 3 show a first preferred embodiment of variable camshaft phase changing apparatus according to the present invention.

As typically shown in FIG. 1, a sprocket of a rotary body 1 is provided to which a rotational force (a torque) is transmitted from an engine crankshaft via a timing chain. A camshaft 2 on end of which a sleeve 3 is fixed by means of a bolt 4 through an axial direction thereof and having a cam on a peripheral surface thereof is provided and a phase conversion mechanism 5 is intervened between a cylindrical main body 1*a* of the sprocket 1 and the sleeve 3 on the camshaft 2. A hydraulic circuit 6 is provided for moving the phase conversion mechanism 5 in an axial direction of the camshaft 2 according to an engine driving condition as will be described later.

A gear portion 1*b* of the sprocket 1 on which the timing chain is wound is fixed by means of the bolt 7 at one end of a cylindrical main body 1*a* which faces the camshaft 2. In addition, a front cover 8 is caulked on a front end portion of the sprocket 1. Beveled type teeth 9 are formed on an inner peripheral surface of a front end portion of the sprocket 1.

In addition, an inner periphery at the bent center of the gear portion 1*b* is slidably supported on the outer peripheral surface of the camshaft 2. Furthermore, the front cover 8 is approximately of a cylindrical shape and is formed with a supporting hole 8*a* at a center thereof.

As typically shown in FIG. 2, the camshaft 2 has one end which faces the sleeve is journaled by means of a camshaft bearing installed on an upper end of a cylinder head on a cylinder block 10. The sleeve 3 is approximately of a cylindrical shape and has a hole 3*a* formed so as to be penetrated in an axial direction of an inner part of a partitioning wall located at a center of the sleeve 3.

A cylindrically fixed end of the sleeve 3 is fitted into one end of the camshaft 2. On the other hand, a fitting groove 3*b* is formed within a cylindrical tip end of the sleeve 3 into which a head of the bolt 4 is fitted. Beveled type outer teeth 13 are formed on an outer periphery of the cylindrical tip end of the sleeve 3. In addition, a coil spring 12 is interposed between a bottom surface of the fitting groove 3*b* and a cylindrical inner periphery of the front cover 8 and is biased in a direction such that the sprocket 1 is separated from the camshaft 2 to suppress a generation of a striking sound against the camshaft 2 due to a thrust force acted toward the sprocket 1.

In the embodiment, the phase conversion mechanism 5 includes: a cylindrical gear 14 interposed between the sleeve 3 and the cylindrical main body 1*a* of the sprocket 1; and a piston 15. The cylindrical gear 14 includes two gear elements split in a direction perpendicular to the axis of the camshaft 2; a first gear element and a second gear element. Beveled inner teeth 14*a* and outer teeth 14*b* are formed on inner and outer peripheral surfaces of the cylindrical gear 14 which are meshed with first end inner teeth 9 of the main body 1*a* of the sprocket 1 and an outer teeth 13 of the sleeve 3. In addition, both of the first and second gear elements of the cylindrical gear 14 are linked elastically in a direction so as to mutually approach to each other by means of a pin 16 and the sprocket 1 in order to absorb clearances due to backlashes generated between each of the teeth 9, 13, 14*a*, and 14*b*. The piston 15 is approximately of a cylindrical shape and is linked to the second gear element via a supporting pin 17 inserted under a pressure into the cylindrical gear 14 at a predetermined position in the peripheral direction thereof.

As typically shown in FIG. 1, a hydraulic circuit 6 serves to supply or exhaust (drain) working oil (hydraulic pressure) to or from an advance-angle side working oil (hydraulic) chamber 18 formed at a front side (a left-handed side in FIG. 1) of the phase conversion mechanism 5 and to supply or exhaust the hydraulic pressure to or from a retardation-angle side working oil (hydraulic) chamber 19 formed at a rear side (a right-handed side in FIG. 1) of the phase conversion mechanism 5, respectively.

An oil pump 21 serves as a hydraulic source. The working oil within an oil pan 20 is pressurized and supplied by the oil pump 21 toward an electromagnetic type controlled valve 22 via a pressurized hydraulic supply passage 23.

The hydraulic circuit 6 further includes: a pair of first and second working oil (hydraulic) passages 24 and 25 branched from the electromagnetic type hydraulic control valve 22 and connected to the corresponding one of the advanced-angle side and the retardation-angle side hydraulic chambers 18 and 19; and a pair of first and second hydraulic drain passages 26 and 27 connected to both ends of the electromagnetic type hydraulic control valve 22 for returning the working oil exhausted from the corresponding one of the advance-angle side and the retardation-angle side hydraulic chambers 18 and 19 to the inside of the oil pan 20.

The pair of the first and second hydraulic passages 24 and 25 are approximately juxtaposed into a working oil passage element 30. One end of the first (working oil) hydraulic passage 24 is communicated into the advance-angle side (working oil) hydraulic chamber 18 via a communication hole 28 in a crank shape formed within the front cover 8 and one end of the second working oil passage 25 is communicated into the retardation-angle side (working oil) hydraulic chamber 19 via a communication hole 29 formed within the bolt 4 and the sleeve 3. It is noted that the working oil element 30 is formed independently of the sprocket 1 and the camshaft 2. A lower end 30*a* of the working oil element 30 is fixed on a side part of the cylinder block 10 by means of a bolt. On the other hand, a cylindrical upper end 30*b* of the working oil passage element 30 is inserted into a supporting hole 8*a* of the front cover 8 via a seal ring 31 having a wear resistance characteristic so that the front cover 8, in other words, the front end of the sprocket 1 is rotatably supported on the upper end 30*b* of the working oil passage element 30.

As typically shown in FIGS. 1, 3, and 4, the electromagnetic hydraulic control valve 22 includes: a predetermined hole 32 (viz., a retaining hole and, hereinafter, referred to as the retaining hole) formed in a side wall portion of the cylinder block 10 (engine body); a cylindrically shaped valve body 33 inserted into the retaining hole 32 and fixed tightly onto the retaining hole 32; a spool valve body 35 slidably installed in a valve body hole 34 within the valve body 33 (the valve body hole 34 is defined substantially by the valve body 33); and an electromagnetic actuator 36 of a proportional solenoid type for respectively actuating the spool valve body 35 to slidably move in an axial direction thereof against a biasing force exerted by a valve spring 45.

The valve body 33, as typically shown in FIG. 1, includes; a supply port 37 penetrated and formed on an approximately center portion of its peripheral wall of the valve body 33 so as to communicate between a downstream end of the supply passage 23 connected to the oil pump 21 and the valve body hole 34; first and second ports 38 and 39 (also called, hydraulic supply-and-draining ports) penetrated and formed on both left and right sides in a lateral direction as viewed from FIG. 1 with respect to the supply port 37 so as to communicate other ends of the first and second hydraulic passages 24 and 25 with the valve body hole 34. Annular grooves 37*a*, 40*a*, and 41*a* having larger diameters than that of the inner peripheral surface of the valve body 33 are formed on the inner surface of third and fourth ports 40 and 41 (also called, draining ports). The third and fourth ports 40 and 41 are formed on further left and right sides of the first port 38 and of the second port 39, respectively, in the lateral direction of the valve body 33, each for the connection thereof to the corresponding one of the first and second hydraulic drain passages 26 and 27 connected to the oil tank 20.

Five annular hydraulic pressure introducing grooves 60, 61, 62, 63, and 64 are formed on respective portions of the inner peripheral surface of the retaining hole 32 which correspond to the supply port 37, the first and second ports (supply-and-draining ports) 38 and 39, and the third and fourth ports (draining ports) 40 and 41.

It is noted that annular four first through fourth sealed surfaces 65, 66, 67, and 68 are formed between the respective portions of the retaining hole 32 which correspond to the respectively hydraulic introducing grooves 60, 61, 62, 63, and 64 and the outer peripheral surface of the valve body 33. It is also noted that the first and fourth sealed surface 65 and 66 described above and shown in FIG. 1 correspond to one of the sealed surfaces defined in claims and the second and third sealed surfaces 61 and 68 described above and shown in FIG. 1 correspond to the other of the sealed surfaces defined in the claims.

The spool valve body 35 is provided with a first valve body 42 having a larger diameter than another part of the spool valve body 35 for opening or closing the supply port 37 at the center of a small-diameter axis portion of the spool valve body 35 and provided with large-diameter second and third valve bodies 43 and 44 for opening or closing the third and fourth ports 40 and 41 at both ends of the small-axis portion of the spool valve body 35.

In addition, the spool valve body 35 is provided with a valve spring 45 of a conical shape resiliently intervened between an umbrella portion 35*b* of the spool valve body 35 and a spring seat 33*a*. The umbrella portion 35*b* is located at one end edge of a supporting axle 35*a* at the front end of the spool valve body 35. The spring seat 33*a* is located on an inner peripheral wall of the valve hole 34 at its front end. The valve spring 45 is biased in the arrow-marked rightward direction of FIG. 1 so that the first valve portion 42 serves to communicate the supply port 37 with the second working oil passage 25 via the sixth port 39. The electromagnetic actuator 36 includes a core 46, a movable plunger 47, a coil 48, and a connector 49. A drive rod 47*a* is fixed on a tip of the movable plunger 47 for pressing the umbrella portion 35*b* of the spool valve body 35. The electromagnetic actuator 36 is actuated or controlled upon a receipt of a control signal having a predetermined pulsewidth from a controller 50, the controller 50 determining an engine driving condition from a revolution speed sensor and an engine load sensor (not shown) and outputting the control signal to the electromagnetic actuator 36 whose pulsewidth is dependent on the engine driving condition.

Figure 4:
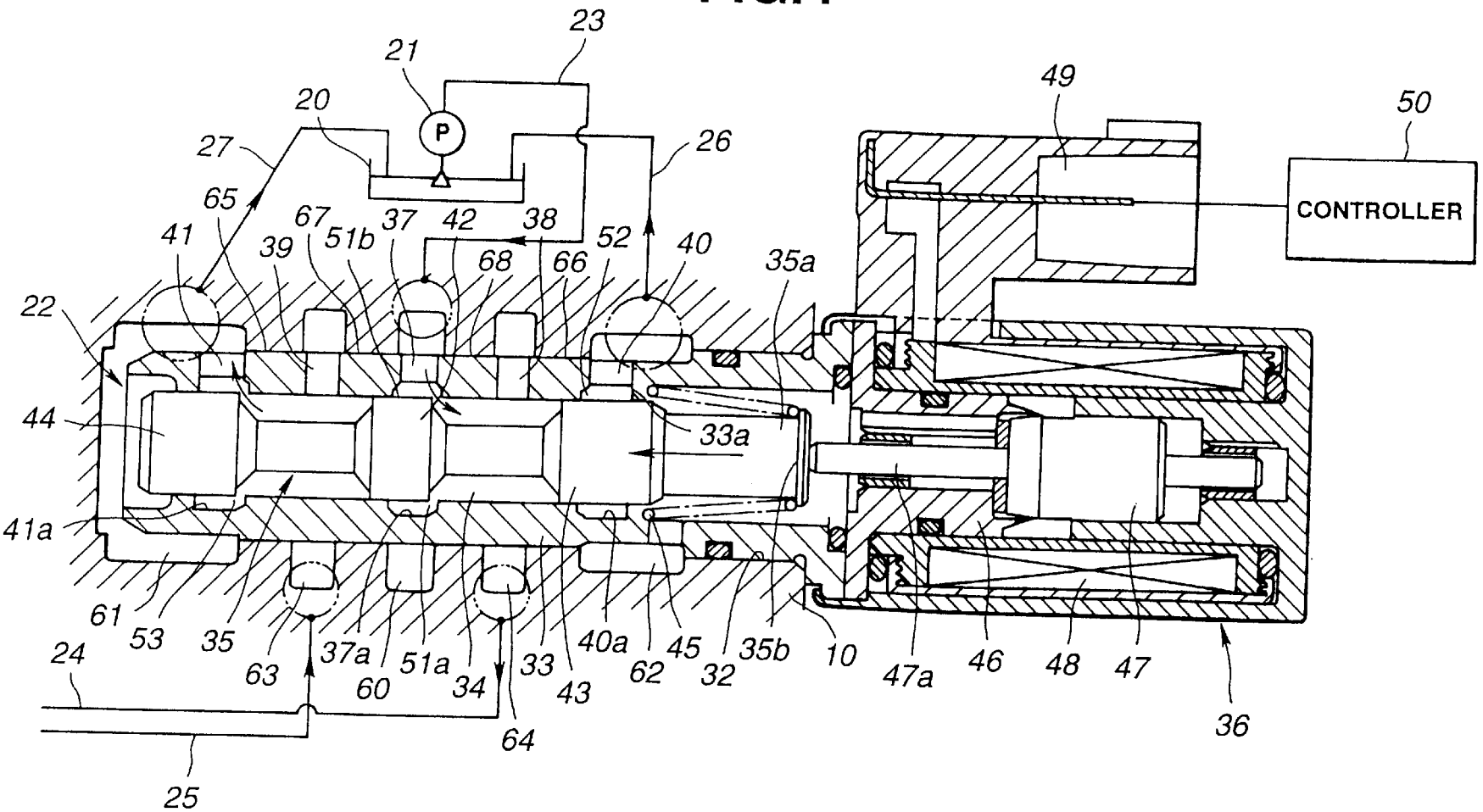

As shown in FIGS. 1 or 4, together with a sliding movement of the spool valve body 35 toward a maximum forward direction (maximum rightward direction of FIG. 1) or a rearward direction (maximum leftward direction of FIG. 4) of the spool valve body 35, during the phase retardation angle control operation (FIG. 1) or the phase advance angle control operation (FIG. 4), a cross sectional area of one of orifices of hydraulic supply control orifices 51*a* and 51*b* formed between both end edges of the first valve part 42 and both inner edges of the groove 37*a* of the supply port 37 is set so as to be slightly wider than the cross sectional area of one of hydraulic exhaust control orifices 52 and 53 formed between respective end edges of the second and third valve parts 43 and 44 and respective end edges of the grooves 40*a* and 41*a* of the third and fourth ports 40 and 41. In other words, the hydraulic exhaust control orifices 52 and 53 are rather throttled. The throttling quantity is set so as not to affect the movement of the cylindrical gear 14 by means of the pressurized working oil supplied within each hydraulic chamber 18 and 19.

As shown in FIG. 3, during an intermediate position control in which the spool valve body 35 is placed at an intermediate position between the maximum leftward and rightward positions, a seal width a by which the third valve part 44 seals the end edge of the groove 41*a* of the fourth port 41 is set to be wider than a seal width b by which the first valve part 42 seals one end edge (51*b*) of the groove 37*a*. In addition, the seal width c by which the first valve part 42 seals the other end edge (51*a*) of the groove 37*a* of the supply port 37 is set so as to be narrower than the seal width d by which the second valve part 43 seals the other end edge (52) of the groove 40*a* of the third port 41. Furthermore, each of the seal widths of b and c is narrower than each of the seal widths of a and d. Thus, at the intermediate position of the spool valve body 35 described above, the spool valve body 35, the valve body 33, and the valve body hole 34 are formed so that the pressurized working oil from the supply port 37 is leaked slightly into respective hydraulic chambers 18 and 19 via respective hydraulic passages 24 and 25.

Furthermore, as typically shown in FIG. 1, the first through fourth sealed surfaces 65 through 68 are defined as follows:

A length or each of the first and second sealed surfaces 65 and 66 located at approximately both ends of the valve body 33, viz., at positions of the valve body 33 which are adjacent to the respective draining ports (third and fourth ports) 40 and 41 is longer than that of each of the third and fourth surfaces 67 and 68 located at the center portion of the valve body 33.

In details, an axial length S1 and S1 of each of the first and second sealed surfaces 65 and 66 at the respective ends at which a pressure difference in terms of the working oil streamed into the first hydraulic introducing groove 60 at the center of the valve body 33 is relatively large is longer than an axial length S2 and S2 of each of the third and fourth sealed surface 67 and 69 at the center portion in FIG. 1 at which the pressure difference is relatively small. That is to say, S1>S2.

An operation of the phase changing apparatus in the embodiment according to the present invention will be described below with reference to FIGS. 1, 3, and 4.

In the embodiment, during a low-speed-and-light-engine-load region of the engine driving condition, an OFF signal (,i.e., the control signal of a minimum pulsewidth (zero)) is outputted to the electromagnetic actuator 36 from the controller 50. The spool valve body 35 is slid along the valve body 33 in the rightward direction (at a minimum position shown in FIG. 1) by means of a spring force (biasing force) exerted by the valve spring 45 (with the drive rod 47*a* drawn into the electromagnetic actuator 36).

Hence, at the same time when the first valve part 42 of the spool valve body 35 opens the one supply control orifice 51*b* of the groove 37*a* of the supply port 37, the second valve part 43 opens the one hydraulic exhaust (draining) control orifice 52 of the groove 40*a* of the third port 40. Then, the third valve part 44 closes the other exhaust control orifice 53 of the groove 41*a* of the fourth port 41.

The working oil pressurized and supplied from the oil pump 21 is speedily supplied to the retardation-angle side hydraulic chamber 19 via the supply port 37, the one hydraulic supply control orifice 51*b*, the valve body hole 34, the second (the supply-and-draining) port 39, and the second hydraulic passage 25. In addition, the working oil within the advance-angle side hydraulic chamber 18 is rather slowly exhausted (drained) within the oil pan 20 via the first hydraulic passage 24, the first port 38, the valve body hole 34, the other hydraulic exhaust control orifice 52, the third (draining) port 40, and the first hydraulic drain passage 26.

Hence, an inner pressure of the retardation-angle side hydraulic chamber 19 becomes high but that of the advance-angle side working oil chamber 18 becomes low. Consequently, the cylindrical gear 14 is moved at the maximum forward end (leftmost end) via the piston 15 as shown in FIG. 2. Thus, the sprocket 1 is relatively pivoted at one side so that the phase is converted, thereby a valve opening timing of a suction valve(s) being lagged through the cam of the camshaft 3 and a valve overlap to an exhaust valve(s) being reduced. A combination efficiency can be improved and stable drive and improvement in a fuel economy can be achieved.

Furthermore, as described above, the cylindrical gear 14 moves toward the maximum forward direction along with a higher pressurization in the retardation-angle side hydraulic chamber 19. However, since the throttling effect of the hydraulic exhaust control orifice 52 causes the exhaust velocity of the working oil toward the hydraulic source (oil pan 20) to be lowered, an abrupt drop in pressure of the advance-angle side working oil (hydraulic) chamber 18 can be suppressed.

A movement responsive characteristic of the cylindrical gear 14 is, thus, improved and an excessive movement of the cylindrical gear 14 (as the movable body) toward the forward direction, i.e., toward the advance-angle side working oil (hydraulic) chamber 18 can be suppressed.

Specifically, since a movement control over the piston 15 is carried out with the responsive hydraulic chambers 18 and 19 maintained under the relatively high pressures, a value of an apparent volume elastic modulus of the working oil within the respective hydraulic chambers 18 and 19 become large. Consequently, a movement time lag of the piston 15 (or the cylindrical gear 14) becomes small and the responsive characteristic is improved. That is to say, $P=K(Q-AY)/V$, wherein P denotes the inner pressure of each working oil chamber 18 and 19 per unit time, K denotes the apparent volume elastic modulus of the working oil, Q denotes a flow quantity of the working oil into and from each hydraulic chamber 18 and 19, A denotes a cross sectional area of the piston 15, Y denotes a piston velocity, and V denotes a volume of each hydraulic chamber 18 and 19.

Therefore, the inner pressure in each working oil chamber 18 and 19 is proportional to the apparent volume elastic modulus of the working oil. The movement responsive characteristic of the piston 15 can be improved by maintaining the pressure in both of the hydraulic chambers 18 and 19 at high levels.

On the other hand, if the engine driving condition is transferred from the low-engine-revolution-speed-and-heavy-engine-load region to a high-revolution-speed-and-heavy-engine-load region, the control signal of a maximum pulsewidth is outputted to the electromagnetic actuator 36. At this time, the spool valve body 35 is slid in the forward (arrow-marked leftward) direction, as shown in FIG. 4, against the spring (biasing) force exerted by the valve spring 45 with the drive rod 47*a* extended at a maximum from the electromagnetic actuator 36.

At the same time when the second valve part 43 closes the hydraulic exhaust control orifice 52 of the groove 41*a* of the fourth port 41, the third valve part 44 opens the exhaust control passage 53. The first valve part 42 closes the one hydraulic supply control orifice 51*b* of the groove 37*a* of the supply port 37 and opens the other hydraulic supply control orifice 51*a* of the groove 37*a* of the supply port 37.

Hence, the working oil is supplied into the advance-angle side hydraulic chamber 18 via the other supply control orifice 51*a,* the first port 38, and the first hydraulic passage 24.

In addition, the working oil within the retardation-angle side hydraulic chamber 19 is exhausted into the oil pan 20 via the second hydraulic passage 25, the second port 39, the one hydraulic exhaust control orifice 53, the fourth port 41, and the second drain passage 27. The inner pressure of the retardation-angle side hydraulic chamber 19 becomes low. Hence, the cylindrical gear 14 moves conversely toward the maximum rear end (,i.e., toward the lowered hydraulic chamber 19). Thus, the relative phase conversion of both camshaft 2 and the sprocket 1 is carried out so that the opening timing and the closing timing of the intake valve(s) are advanced. Consequently, the valve overlap with the exhaust valve(s) can be enlarged, the output of the engine due to an improvement in a suction charge efficiency can be enlarged.

It is noted that the abrupt reduction of pressure of the retardation-angle side hydraulic chamber 19 is suppressed due to the throttling effect of the exhaust control orifice 53 so that the improvement in the movement responsive characteristic and the excessive movement of the cylindrical gear 14 can be prevented. Then, the stable movement of the cylindrical gear 14 can be achieved.

Next, when the engine driving condition is transferred into a middle-engine-revolution-speed-and-a-middle-engine-load region, the spool valve body 35 in response to the control signal from the controller 50 closes all of the supply port 37 and the third and fourth ports 40 and 41 with the spool valve body 35 held at the intermediate position, as shown in FIG. 3.

Hence, the cylindrical gear 14 is held at an intermediate position and the opening and closing timings of the suction valve(s) is controlled at predetermined opening and closing timings. Hence, the engine performance according to the engine driving condition can sufficiently be improved.

The seal widths b and c of both end edges between the first valve part 42 and the groove 37*a* of the supply port 37 are set to be narrower than those of a and d described above.

Hence, the working oil supplied under the pressure to the supply port 37 is slightly leaked into the valve port 34 from the parts of the seal widths b and c. Furthermore, a slight quantity of the working oil from the supply port 37 is supplied to each hydraulic chamber 18 and 19 via the respective first and second ports 38 and 39 and the first and second hydraulic passages 24 and 25.

Thus, it is possible to stably hold the cylindrical gear 14 at an intermediate movement position between the maximum forward and maximum rearward positions via the piston 15.

In addition, since it is not necessary to largely set the first valve part 42 of the spool valve body 35 in the axial direction of the spool valve body 35, the length of the spool valve body 35 in the axial direction can be shortened. Consequently, the whole electromagnetic type hydraulic control valve 22 can be compacted.

Furthermore, as described above, since each axial length S1 and S1 of the first and second sealed surfaces 65 and 66 placed at the large pressure difference position is set to be longer than each axial length S2 and S2 of the third and fourth sealed surfaces 67 and 68, the pressurized working oil streamed via the valve body hole 34 into the first port 38 or the second port 39 and into the second hydraulic introducing groove 63 or the third introducing groove 64 is effectively blocked from leaking into the fourth and fifth introducing groove 61 or 62 by means of the first or second sealed surface 65 or 66.

Especially, as shown in FIG. 3, suppose such a situation that the cylindrical gear 14 is held at the predetermined intermediate portion with the spool valve body 35 placed at the intermediate position to close all of the supply port 37 and the third and fourth ports 40 and 41. Under this state, even if a plus-and-minus rotation variation (fluctuation) torque developed on the camshaft 2 cause each hydraulic chamber 18 or 19 to be compressed via the cylindrical gear 14 and the piston 15 so that the fluctuated hydraulic pressure is acted upon the working oil within the valve body hole 34, each of the first and second sealed surfaces 65 and 66 can sufficiently block the leakage of the working oil into each hydraulic introducing groove 61 and 62. Consequently, an unstable motion of the cylindrical gear 14 and the piston 15 can be prevented and the stable valve timing at the intermediate position of the spool valve body described above can be achieved.

In addition, since the leakage of the working oil can effectively be blocked, a consumption of the working oil can remarkably be saved. The supply of the lubricating oil to the slide parts such as engine pistons can become sufficient.

Furthermore, since the sealed surfaces 65 through 68 serve to hermetically seal the working oil present in the hydraulic control valve without use of the seal member such as O-ring, an efficiency of manufacturing and assembling the hydraulic control valve can be improved and its cost can be reduced.

A combination of the feature of the sealed surface relationship described in the embodiment with the seal structure of the previously proposed cam phase changing apparatus described in the BACKGROUND OF THE INVENTION is possible.

Although the phase conversion mechanism 5 described in the embodiment includes the cylindrical gear 14 and the piston 15 as described above, the present invention is applicable to a vane type cam phase changing apparatus having the phase conversion mechanism only constituted by a single element.

The phase conversion mechanism of the van type cam phase changing apparatus is exemplified by a Japanese Patent Application First Publication No. Heisei 8-121124 published on May 14, 1996.

In details, in the disclosed cam phase changing apparatus, the timing pulley, a shoe-shaped housing, and a front plate are coaxially fixed by means of two bolts. In addition, the timing pulley, the shoe-shaped housing, and a rear plate are coaxially fixed by means of four bolts. An inner peripheral wall of a boss of the rear plate is fitted to a tip of the camshaft so as to be enabled to be relatively pivotable to the camshaft. An outer peripheral wall of the boss of the rear plate is contacted against an oil seal of the cylinder head. The shoe-shaped housing is a housing of a vane rotor so as to enable the vane rotor to be pivoted about its axis and includes a pair of mutually opposed trapezoid-shaped first and second shoes. Each of mutually opposed surfaces of the pair of the first and second shoes is formed of an arc shape in cross section. Circumferential clearances of the first and second shoes are formed with arc shaped spaces as housing chambers. Each of flange portions of the shoe housing is inserted between the timing pulley and the rear plate and is fixed by means of a bolt. In addition, both radial ends of the vane rotor are formed as arc-shaped first and second vanes. The arc-shaped first and second vanes are pivotably housed in the arc-shaped spaces of the first and second shoes of the shoe-shaped housing. An inner wall portion of the vane rotor is coaxially fitted onto the camshaft by means of two bolts. A cylindrical projection of the vane rotor is mutually pivotably fitted to the inner peripheral wall of the boss of the front plate, Minute clearances are provided between an outer peripheral wall of the vane rotor and an inner peripheral wall of the shoe-shaped housing so that the vane rotor can be pivoted relative to the shoe-shaped housing. The minute clearances are sealed by means of a pair of seal members. It is noted that one of two retardation-angle side hydraulic chambers is formed between the first shoe and the first vane, the other retardation-angle side hydraulic chamber is formed between the second shoe and the second vane, and the other advance-angle side hydraulic chambers is formed between first shoe and the second vane, and the other advance-angle side hydraulic chamber is formed between the second shoe and the first vane. In the structure described above, the timing pulley, the shoe-shaped housing, the front plate, and the rear plate can integrally be rotated. The camshaft and the vane rotor can coaxially be pivoted relative to the timing pulley, the shoe-shaped housing, the front plate, and the rear plate. In the disclosed vane type cam phase changing apparatus, the pair of the first and second hydraulic chambers correspond to the two mutually symmetrically opposed advance-angle side hydraulic chambers and the two mutually symmetrically opposed retardation-angle side hydraulic chambers, the phase conversion mechanism correspond to the vane rotor having the first and second vanes, and the pair of the first and second hydraulic passages from the control valve (electromagnetic type hydraulic control valve) are connected to the two mutually symmetrically opposed advance-angle side hydraulic chambers and the two mutually symmetrically opposed retardation-angle side hydraulic chambers, respectively. (The above-identified Japanese Patent Application First Publication No. Heisei 8-121124 is herein incorporated by reference). Thus, the phase conversion mechanism is not limited to a movable body having the cylindrical gear and the piston and moved along the axis of the camshaft as shown in FIG. 1 but may be constituted by the vane rotor pivotably housed in the shoe-shaped housing.

It is noted that the controller 50 determines which one of three regions the engine driving condition falls within according to sensor signals of the engine revolution speed and the engine load, the three regions being the low-engine-revolution-speed-and-light-engine-load region, the middle-engine-revolution-speed-and-middle-engine-load region, and the high-engine-revolution-speed-and-heavy-engine-load region. The controller 50 is exemplified by a U.S. Pat. No. 5,309,873 (,the disclosure of which is herein incorporated by reference).

The entire contents of a Japanese Patent Application P10-154063 (filed in Japan on Jun. 3, 1998) is herein incorporated by reference.

Although the invention has been described above by reference to the embodiment of the invention, the invention is not limited to the embodiment described above.

Modifications and variations of the embodiment described above will occur to those skilled in the art, in light of the above teachings.

What is claimed is:

1. A phase changing apparatus for an internal combustion engine, comprising:

a rotary body driven by the engine to be rotated in synchronization with a revolution of the engine;

a camshaft rotatable about a camshaft axis together with the rotary body;

a phase conversion mechanism, the phase conversion mechanism being intervened between the rotary body and the camshaft, the phase conversion mechanism converting a hydraulic pressure responsive movement into a rotational phase relationship between the rotary body and the camshaft;

a pair of advance-angle and retardation-angle side hydraulic chambers, the pair of the advance-angle and retardation-angle side hydraulic chambers being formed in an inner space between the rotary body and the camshaft and partitioned by the phase conversion mechanism and moving the phase conversion mechanism according to the difference in the hydraulic pressures supplied thereinto;

a hydraulic circuit, the hydraulic circuit including a plurality of hydraulic passages relatively supplying and draining the hydraulic pressures to and from the pair of the advance-angle side and the retardation-angle side chambers via the hydraulic passages to create a difference in the hydraulic pressures between the pair of the advance-angle and the retardation-angle side hydraulic chambers and having hydraulic draining passages; and a hydraulic pressure control valve, the hydraulic pressure control valve being interposed in the hydraulic circuit and controllably switching a direction of a working oil between the respective hydraulic passages, the hydraulic pressure control valve including: a valve body fixedly inserted into a predetermined hole; a hydraulic supply port, the supply port being formed on a peripheral wall of the valve body and being communicated with a hydraulic pressure source; a plurality of hydraulic supply-and-draining ports, each supply-and-draining port being formed on the peripheral wall of the valve body and being communicated with the corresponding one of the hydraulic passages; a plurality of hydraulic draining ports, each of the draining ports being formed on the peripheral wall of the valve body and being communicated with the corresponding one of the hydraulic draining passages; a spool valve body slidably installed within the valve body, the spool valve body opening and closing the supply port and the draining ports; and a plurality of hydraulic pressure introducing grooves, each hydraulic pressure introducing groove being formed between an inner peripheral surface of the predetermined hole and an outer peripheral surface of the valve body, and wherein a plurality of sealed surfaces are formed between the inner peripheral surface of the predetermined hole and the outer peripheral surface of the valve body and wherein a length of one of the sealed surfaces having a first difference in pressure is set to be longer than that of the other of the sealed surfaces having a second difference in pressure, the first difference in pressure being larger than the second difference in pressure.

2. A phase changing apparatus for an internal combustion engine as claimed in claim 1, wherein the one sealed surface is located between one of the hydraulic pressure introducing grooves formed on the corresponding one of the draining ports and the other of the hydraulic pressure introducing groove formed on the corresponding one of the supply-and-draining ports and the other of the sealed surfaces is located between one of the hydraulic pressure introducing grooves formed on the corresponding one of the supply-and-draining ports and the other one of the hydraulic pressure introducing grooves formed on the supply port.

3. A phase changing apparatus for an internal combustion engine as claimed in claim 2, wherein the predetermined hole is formed of a substantially cylindrical shape in body of the engine and an axial length (S1) of the one sealed surface in an axial direction of the valve body is set to be longer than that (S2) of the other sealed surface.

4. A phase changing apparatus for an internal combustion engine as claimed in claim 1, wherein the phase conversion mechanism comprises a cylindrical gear, the cylindrical gear being meshed between the rotary body and the cam shaft and including inner and outer teeth, at least one of the inner and outer teeth being formed with a helical gear and being slid in an axial direction of the cam shaft.

5. A phase changing apparatus for an internal combustion engine as claimed in claim 3, wherein each of the hydraulic pressure introducing grooves is formed in a substantially annular shape on the corresponding one of the supply port, the supply-and-draining ports, and the draining ports.

6. A phase changing apparatus for an internal combustion engine as claimed in claim 3, wherein the hydraulic control valve further includes an actuator and a spring, the actuator operatively actuating the spool valve body to slidably move the spool valve body against a biasing force exerted by the spring to open the supply port, to close one of the draining ports, and to open the other of the draining ports in response to a pulse duty ratio signal having a maximum pulsewidth inputted thereto, a cross sectional area of an orifice formed by the other of the draining ports and by a third valve body part (44) of the spool valve body when the other of the draining ports is opened being set to be narrower than that of another orifice formed by the supply port and by a first valve body part (42) of the spool valve body when the supply port is opened.

7. A phase changing apparatus for an internal combustion engine as claimed in claim 3, wherein the hydraulic control valve further includes an actuator and a spring, the actuator deactivating the spool valve body in response to a pulse duty signal having a minimum pulsewidth inputted thereto and a biasing force exerted by the spring causing the spool valve body to open the supply port, to close one of the draining ports, and to open the other of the draining ports, a cross sectional area of an orifice formed by the other of the draining ports and by a second valve body part (43) of the spool valve body being set to be narrower than that of another orifice formed by the supply port and by a first valve body part (42) of the spool valve body.

8. A phase changing apparatus for an internal combustion engine as claimed in claim 7, wherein in response to the pulse duty signal having an approximately 50%, the actuator actuating the spool valve body to slidably move the spool valve body to close all of the supply port and the draining ports, a sealing width (b and c) formed by the supply port and each of the first valve body part of the spool valve body being set to be narrower than that (a) formed by one of the draining ports and by a third valve body part (44) of the spool valve body and than that (d) formed by the other of the draining ports and by the second valve body part (43) of the spool valve body.

9. A phase changing apparatus for an internal combustion engine as claimed in claim 6, which further comprises a controller, the controller determining an engine driving condition and outputting the pulse duty ratio signal to the actuator having the maximum pulsewidth when the engine driving condition falls in a region of a relatively high-engine-speed-and-engine-load state.

* * * * *